US005581829A

United States Patent [19]

Lee

[11] Patent Number: 5,581,829

[45] Date of Patent: Dec. 10, 1996

[54] BEDDING APPAREL OR ACCESSORY WITH POCKETS

[76] Inventor: Christian Lee, 2340 S. Shore Blvd., Lake Oswego, Oreg. 97034

[21] Appl. No.: 533,244

[22] Filed: Sep. 25, 1995

[51] Int. Cl.[6] ..... A47C 21/00

[52] U.S. Cl. ..... 5/503.1; 5/658; 224/42.11; 383/38; 383/39

[58] Field of Search ..... 5/503.1, 658, 485; 383/38, 39; 224/42.11, 609

[56] References Cited

U.S. PATENT DOCUMENTS

| | | | |
|---|---|---|---|
| 3,717,188 | 2/1973 | Green | 224/42.11 |
| 4,129,909 | 12/1978 | Riehl | 5/503.1 |
| 5,279,009 | 1/1994 | Putka, Jr. | 5/485 |
| 5,294,030 | 3/1994 | Jollivette | 383/38 |

FOREIGN PATENT DOCUMENTS

| | | | |
|---|---|---|---|
| 669516 | 12/1938 | Germany | 383/38 |

*Primary Examiner*—Alexander Grosz
*Attorney, Agent, or Firm*—Frank L. Zugelter

[57] ABSTRACT

A bedding accessory (10) for storing articles wherein pocket assemblies or arrangements (24, 25) provide a pair of layers or leaves (26, 27) having corresponding pockets (28, 29), the arrangements adapted to hang down along the sides of a bed (11). The one layer (26) with its pocket (28) is hidden. The one layer (24) is formed by a segment (30) that is an extension of a central portion (21) of a sheetlike-member (18) and a panel (31). The second layer (26) is formed by a pair of panels (34, 35), the panel (34) having a lip (39) attached to the segment (30) over the mouth (33) provided for pocket (28) in the first layer. Pocket assembly (25) is flippable onto a central portion (18) of accessory (10) to thereby gain access to pockets (28).

12 Claims, 2 Drawing Sheets

10
11
12
13
14
15
16
17
18
21
22
24
25

BEDDING APPAREL OR ACCESSORY WITH POCKETS

TECHNICAL FIELD

This invention relates to an apparel or accessory applied to bedding and by which various kinds and sundries of articles can be lodged or stored within pockets formed in the apparel or accessory and which hang along sides of the bedding.

BACKGROUND TO THE INVENTION

This invention is an improvement over U.S. Pat. No. 4,129,909 granted to Rhiel on Dec. 19, 1978. Rhiel discloses an appliance having pockets therein for the storage of articles. Rhiel comprises a sheet-like unitary member that reaches across and beyond the width of a bed so that pockets in the member hang along both sides of the bed. Its specification describes and its FIGURES illustrate various ways or embodiments by or in which storage pockets are found in the unitary member, and adapted for hanging along the sides of a bed. However, none of Rhiel's ways or embodiments show embodiments or ways of such an apparel or accessory that includes a pocket assembly or arrangement having distinct or separate layer or leafs or leaves of pocket means operatively connected together, with the outermost ones having the capability of being flippable back upon the apparel or accessory itself to expose to the eye another layer or leaf of pocket means. The outermost layer or leaf is connected to the apparel or accessory in a manner that hides the mouth of and the layer or leaf of pocket means immediately under it. The inventive concept begins with a pair pocket assemblies or arrangements along one or the other of or at both termini of a unitary member, the pocket means in each of the plurality of pocket assemblies or arrangements along one or both bedsides facing outwardly, yet only the exteriorly disposed one of the assemblies or arrangements with its pocket means being visibly exposed and the other or others under it are hidden to the eye.

SUMMARY OF THE INVENTION

This invention is directed particularly to a sheet-like member having a pocket assembly or arrangement containing at least two (2) layers or leaves having pockets for storing various and sundry items and articles, preferably an assembly or arrangement at each end of the member. One or more mouths of an exteriorly disposed pocket in its pocket assembly is visible and open, and accessible by hand for introducing and removing such items or articles. The mouth or mouths of pockets in one or more pocket assemblies or arrangements under the exteriorly disposed pocket are exposed to the eye only when the outermost or exteriorly disposed pocket assembly is flipped back, up, and onto the sheet-like member's central portion to which all of the pocket assemblies or arrangements are connected as part and parcel of the accessory or apparel. Each of the mouths of the pockets themselves face outwardly, away from the bedding rather than one or more of them facing inwardly towards the bedding across which the member reaches or is displaced.

The inventive concept is illustrated in the drawing by only one outermost assembly or arrangement and only one hidden directly under it. In such a construction and use, only the outermost pocket assembly or arrangement is exteriorly and openly exposed while the other pocket assembly or arrangement is not visible but rather is found under or covered by the exteriorly and openly exposed pocket assembly. The mouths of each of the pockets in their respective layers or leaves of assemblies or arrangements face outwardly of the bedding rather than one or more of them facing inwardly towards the bedding across which the member reaches or is displaced.

An object of this invention is to provide a novel bedding apparel or accessory for containing and dispensing of various and sundry kinds of items and articles.

Another object of this invention is to provide an arrangement for storage pockets in a bedding apparel not heretofore known or invented.

These and other objects and advantages of the invention will become more apparent by a full and complete reading of the following description, the claims appended thereto, and in the accompanying drawing comprising two (2) sheets of four (4) FIGURES.

PREFERRED MODE OF CARRYING OUT THE INVENTION

Figure 1:
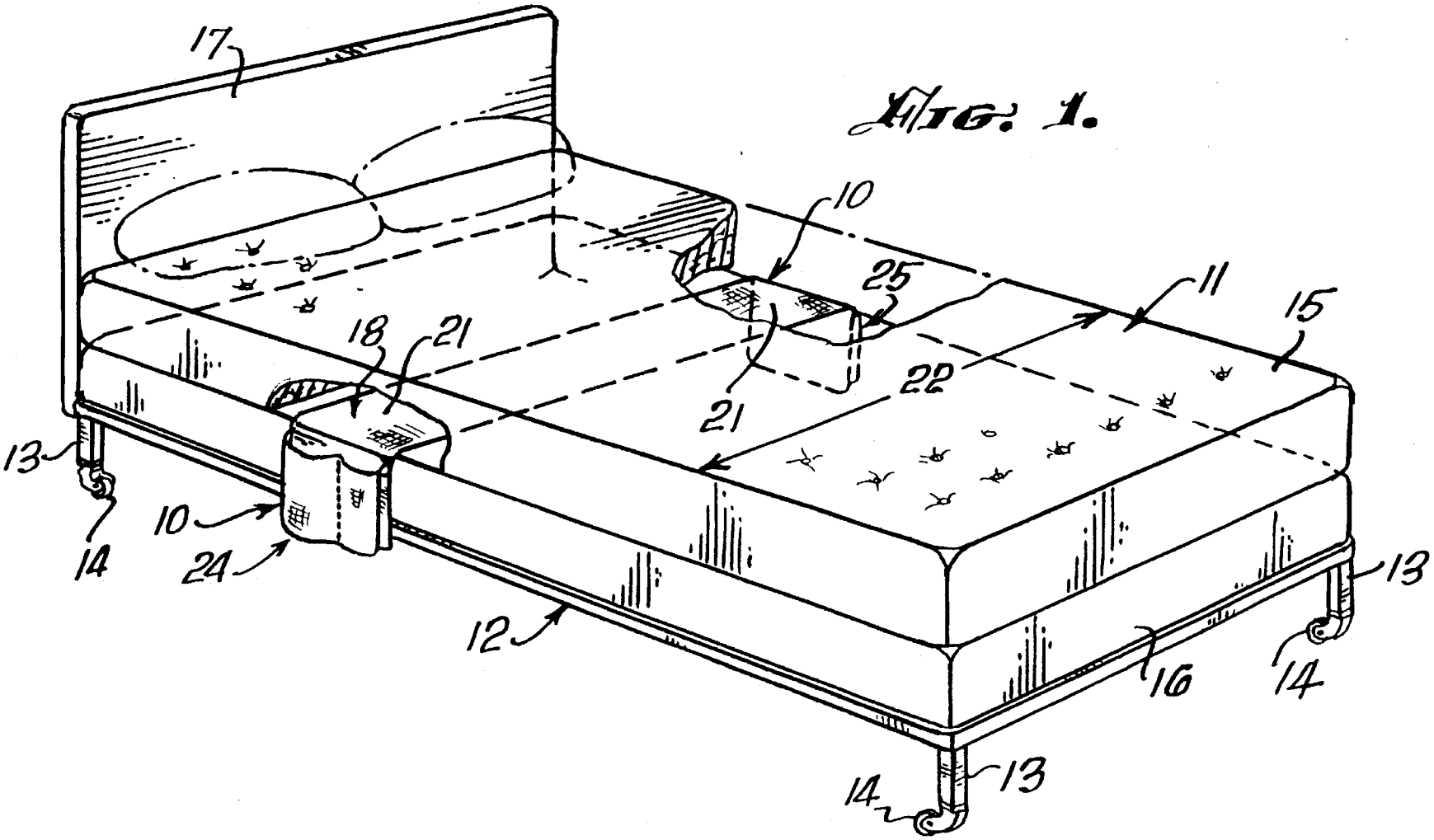
FIG. 1 is a perspective view of the bedding apparel mounted in its position on bedding.

Referring now to the drawing wherein reference characters correspond to like numerals hereinafter, FIG. 1 illustrates a bedding apparel or accessory 10 of the instant invention, mounted in its operable position on a bed 11. The bed 11 is considered one of known construction, having its usual frame 12 mounted on legs 13 to which wheels or casters 14 may be attached for ease of movement of the bed 11, a mattress 15 mounted on a box itself supported by the frame 12, and a headboard 17 spring support 16 for the mattress 15, the support 16 itself supported by the frame 12, and a headboard 17 secured to the bed's frame 12, all of which is not part and parcel of the instant invention. However, they are illustrated to show the manner of use of the subject matter of the invention and in the context of a bedding in which such use of apparel or accessory 10 usually is to be found.

Figures 2, 3, 4:
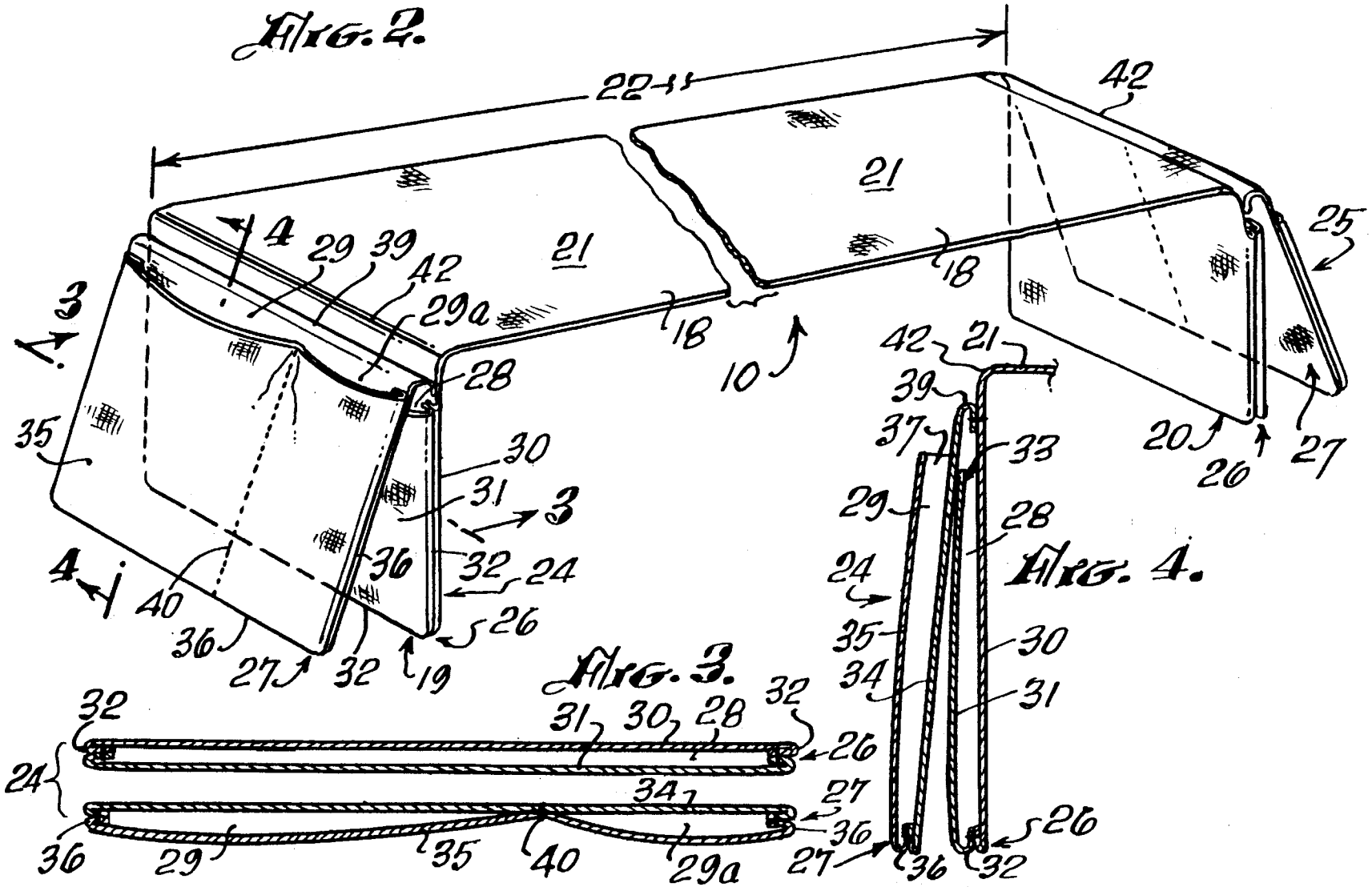
FIG. 2 is a perspective view of the subject matter of the instant invention.
FIG. 3 is a view taken on line 3—3 of FIG. 2.
FIG. 4 is a view taken on line 4—4 of FIG. 2.

Turning to FIGS. 2, 3, and 4. the bedding apparel or accessory 10 comprises an elongated sheet-like member 18 having opposing ends or termini 19, 20. Member 18 preferably is of unitary nature and preferably of general rectangular configuration, and to which the instant invention is easily and readily applied. Its central portion 21 is of a length adapted to reach across the width 22, FIG. 1, of the bed 11 or mattress 15. Although the member 18 is illustrated to be disposed between the mattress 15 and its box spring support 16, it should be understood that it may be disposed on top of and across the mattress 15 (or on or under a bed sheet thereon) as well, should this be desired.

Between the central portion 21 and each terminus 19, 20, pocket assemblies or arrangements 24, 25, respectively, are formed within and as part of the member 18. Each pocket assembly or arrangement 24, 25 comprises, FIG. 2, at least two (2) layers or leaves 26, 27, respectively, in which, FIG. 4, pockets 28, 29, respectively, are disposed. The pocket 28 is formed in layer or leaf 26 by means of a segment 30 in the member 18, from its the central portion 21 to each of the termini 19,20, while a panel 31 is attached, FIG. 2, to segment 30 at its corresponding side and bottom edges 32, the panel 31 being at least co-extensive in its size to that of the segment 30. A mouth 33, FIG. 4, for pocket 28 thus is generated by the attachments at the edges 32 only.

The pocket 29 is formed in layer or leaf 27 by two co-extensively-extending panels 34, 35 and whose corresponding side and bottom edges 36 are attached to one another. A mouth 37, FIG. 4, for the pocket 29 thus is produced. The panel 34 includes a lip 39 or marginal portion along its top, protruding from the panel proper, and which lip 39 is attached across or to the segment 30 in member 18, above or over the mouth 33 for pocket 28. In the illustrated FIGURES, lip 39 is mounted on the panel 34 which is immediately adjacent to the panel 31 in the other layer or leaf of assembly or arrangement 24. Thus, in use it will be observed that the appearances of the pocket assemblies or arrangements 25, which project outwardly from the sides of the bed 11, provide sight of their outwardly exposed pockets 29, formed in the layer or leaf 27. However, the other assemblies or arrangements 24 and their elements remain invisible to the eye, thus producing a hidden or invisible storage chamber for articles or items that are desired not to be openly displayed.

One or more pockets 29, 29*a*, FIG. 2, may be formed in the exteriorly disposed layer or leaf 27 of a pocket assembly or arrangement 25, as illustrated in FIGS. 1 and 2, this being accomplished by stitching 40 between the panels 34 and 35.

In other words, it is apparent that a pocket assembly or arrangement 25 faces outwardly in an open manner and by which its pocket or pockets 29, 29*a* is/are visible and readily usable. However, to gain access to a pocket assembly 24 for use, one must either reach around the side or bottom edges 32 of an assembly or arrangement 25, or must flip the assembly or arrangement 25 up and onto the central portion 21 of the member 18 to expose mouth 33.

In use, the central portion 18 is spread across the width 22 of the box spring support 16, after which the mattress 15 is repositioned atop its box spring support. The pocket assemblies or arrangements 24, 25 hang down along each side of the bed 11, the length of the central portion 18 over the width 22 of the bed 11 providing for this effect. The apparel or accessory 10 now is ready for use by inserting kinds and sundry articles or items into the pockets 28, 29 through their respective mouths 33, 37 of their corresponding pocket assemblies 24, 25 in each of the layers or leaves as desired. They are slipped into mouth 37 of pocket 29 or pocket 29*a* of assembly 25. If the pocket 28 is desired to be used, the layer or leaf 27 is flipped up onto the central portion 21, thereby exposing the mouth 33 of the assembly 24 and through which mouth 33 they may be slipped into pocket 28. Or a hand (not shown) may slip into and under the assembly or arrangement 25 in its layer or leaf, and along a longitudinal edge 32 of an underlying layer or leaf to gain access to the mouth of a pocket in such layer or leaf.

The accessory or apparel 10 is fabricated from sheet-like material associated with bedding, such as fabric, linen, fiberglass, although any suitable and known material may be fabricated into the manufacture 10. Each pocket assembly or arrangement is formed by suitable and known stitching along the corresponding edges 32, 36 of the sides and bottoms of the panels and the segment, and by stitching 40 if desired. The pocket assembly 27 is fabricated preferably in its entirety prior to attaching or stitching its lip 39, FIGS. 2, 4, to segment 30. The panel 31 is stitched to its segment 30 along its corresponding side and bottom edges, and thereafter the lip 39 is stitched into its position across segment 30 above the mouth 33.

In the preferred mode of material, mainly, linen or other fibrous fabric, a piece thereof is cut to the size of the bedding apparel desired, and which includes the central member 18 and its segments 30. Thereafter, like or other material is sized thereto and stitched or otherwise attached together to form the aforesaid described elements and assembled together in an orderly manner to produce the article 10.

Various changes and modifications can be made in the above described details without departing from the spirit and scope of the invention. Sheet-like member 18 need not be unitary in nature. Apparel 10 need not be rectangularly configured, as long as the geometrical form provides for utilization of at least one segment 30 for operative connection to or with panels 34, 35 and the lip 39 on a panel. The lip 39 can be turned either way when being attached to segment 30, or otherwise, as its marginal character over panel 34 is what is required for such attaching. Folds 42, FIG. 2, usually are generated in the fabric of member 18 during actual mounting of it to bedding, however, they may be actually incorporated into the apparel 10 without departing from the spirit and scope of the invention. Pocket 28 may be formed by doubling the size of segment 30, i.e., by doubling over an integral extension of comparable size to the illustrated segment 30, thereby producing an integrated panel 31, so to speak, and eliminating the need for a separate panel 31, and whereby walls for the pocket 28 are also produced. Lip 39 can be turned either way when being attached to segment 30. Buttons, zippers, or VELCRO may replace any of the disclosed stitching should it be desired, functioning as the means of attaching the aforesaid described elements together. The coextensiveness of the side and bottom edges that are attached together does not mean that the material along which such side and bottom edges are drawn and attached together cannot extend beyond the attaching of the corresponding side and bottom edges that are attached together.

INDUSTRIAL CAPABILITY

The manufacturer is most useful in industries concerned with environments of sleeping, resting, reclining, and recovering of the human person, who is not of a mind at the moment to lie motionless on the bed 11.

I claim:

1. In a bedding apparel adapted to be removably placed on a bed having a longitudinal and transverse dimension, said apparel fabricated from a sheet-like member and having a central portion of a length at least equal to the transverse dimension of a bed on which the apparel is used, and at least one segment with side and bottom edges extending from said central portion to a terminus for the apparel, the improvement comprising pocket assembly means having at least two layers of pocket means and adapted to hang down along a side of a bed, the first of said layers formed by said segment and a panel means attached thereto along their corresponding and co-extensive side and bottom edges and by which a pocket having a mouth at the top of said first of said layers is formed, the second of said layers formed by a pair of panel means whose corresponding and co-extensive side and bottom edges are attached together, and protruding means mounted on one of the panel means in said pair of panel means attaching said second layer to said segment.

2. In the improvement of claim 1, the attaching of said protruding means to said segment being over and above the mouth at the top of said first of said layers.

3. In the improvement of claim 2, said protruding means comprising a lip.

4. In the improvement of claim 3, said lip mounted on said one of the panel means, said one of said panel means being disposed immediately adjacent to the panel means attached to said segment.

5. In the improvement of claim 1, the panel means forming said first of said layers being an integral extension of said segment the extension being doubled over said segment and attached thereto along their corresponding side edges.

6. In the improvement of claim 5, said protruding means comprising a lip.

7. In the improvement of claim 6, said lip mounted on said one of the panel means, said one of said panel means being disposed immediately adjacent to the panel means attached to said segment.

8. In the improvement of claim 1, said protruding means being formed on the one of said pair of panel means which is immediately adjacent to the panel means in said first one of said layers.

9. In the improvement of claim 8, said protruding means comprising a lip.

10. In the improvement of claim 9, said lip mounted on said one of the panel means, said one of said panel means being disposed immediately adjacent to the panel means attached to said segment.

11. In the improvement of claim 1, said protruding means comprising a lip.

12. In the improvement of claim 11, said lip mounted on said one of the panel means, said one of said panel means being disposed immediately adjacent to the panel means attached to said segment.

* * * * *